US006453990B2

(12) United States Patent
Higashiyama et al.

(10) Patent No.: US 6,453,990 B2
(45) Date of Patent: Sep. 24, 2002

(54) LAYERED HEAT EXCHANGER

(75) Inventors: Naohisa Higashiyama; Nobuyuki Okuda; Hisashi Ide; Yoshinori Nakata, all of Tochigi (JP)

(73) Assignee: Showa Denko K. K., Tokyo (JP)

( * ) Notice: Subject to any disclaimer, the term of this patent is extended or adjusted under 35 U.S.C. 154(b) by 0 days.

(21) Appl. No.: 09/794,014

(22) Filed: Feb. 28, 2001

(30) Foreign Application Priority Data

Mar. 1, 2000 (JP) ..... 2000-055648

(51) Int. Cl.[7] ..... F28F 9/00
(52) U.S. Cl. ..... 165/178; 165/153; 165/76
(58) Field of Search ..... 165/76, 153, 176, 165/178

(56) References Cited

U.S. PATENT DOCUMENTS 6,260,612 B1 * 7/2001 Nakamura et al. ..... 165/82

FOREIGN PATENT DOCUMENTS

| | | | |
|---|---|---|---|
| DE | 94 20 659 | 2/1994 | |
| EP | 0347 961 | 12/1989 | |
| EP | 0 872 698 | 10/1998 | |
| JP | 62-46195 A1 * | 2/1987 | ..... 165/76 |

* cited by examiner

*Primary Examiner*—Allen Flanigan
(74) *Attorney, Agent, or Firm*—Armstrong, Westerman & Hattori, LLP

(57) ABSTRACT

A layered heat exchanger for use in evaporators or the like has a pipe mount plate which is given improved amenability to brazing at the portion thereof between a fluid introduction pipe socket and a fluid discharge pipe socket provided on the plate. This feature reliably precludes the development of a shortcut channel between the fluid introduction channel and the fluid discharge channel due to a faulty brazed joint.

8 Claims, 3 Drawing Sheets

LAYERED HEAT EXCHANGER

BACKGROUND OF THE INVENTION

The present invention relates to layered heat exchangers, for example, for use as evaporators for motor vehicle air conditioners.

Layered heat exchangers made of aluminum and adapted, for example, for use as evaporators for motor vehicle air conditioners generally have a heat exchange portion for subjecting the refrigerant flowing through a refrigerant channel and the air flowing outside the refrigerant channel to heat exchange. The heat exchange portion is provided by a required number of aluminum intermediate plates arranged in superposed layers, and a pair of end plates positioned respectively at opposite ends the assembly of the intermediate plates in the direction of superposition thereof. Conventionally, a pipe mount plate is brazed to the upper portion of outer surface of the end plate at one end of the heat exchange portion, two pipe sockets arranged side by side at front and rear are provided on the mount plate, and a refrigerant introduction pipe and a refrigerant discharge pipe are inserted into the respective sockets for connection.

The intermediate plates, the opposite end plates and the pipe mount plate of the heat exchange portion are brazed in a furnace as by the vacuum brazing method or flux brazing method.

However, in the case of such a furnace brazing method which is practiced in a nitrogen gas atmosphere, faulty brazing (faulty joint) will result unless air is replaced with nitrogen gas. When the pipe mount plate provided with the front and rear two pipe sockets described is brazed to the end plate in the furnace, a fault is liable to occur in the brazed joint between the pipe mount plate and the end plate at the intermediate portion of the mount plate between the two pipe sockets. If such a faulty brazed joint is produced, the refrigerant introduction channel communicates with the refrigerant discharge channel through the faulty joint, forming a so-called shortcut channel at the intermediate portion and giving rise to the problem of internal leakage of the refrigerant.

To overcome this problem, accordingly, it has already been proposed to form a slit 35 in a pipe mount plate 32 at an intermediate position between a refrigerant introduction pipe socket 33 and a refrigerant discharge pipe socket 34 on the plate 32 as shown in FIG. 5 (see, for example, JP-A No. 9-170892). With the layered heat exchanger thus proposed, the pipe mount plate 32 and an end plate 31 are brazed to each other when the heat exchange portion is collectively brazed. Should a fault occur in the brazed joint between the end plate 31 and the mount plate 32 at the intermediate portion of the mount plate 32 between the front and rear two pipe sockets 33, 34 to create a shortcut channel, the presence of the slit 35 will open the shortcut channel to the outside at the portion of the slit 35. When the heat exchanger assembled is checked for fluid leakage, the fluid flowing through the shortcut channel invariably leaks out through the slit 35, whereby the internal fluid leakage can be detected properly to prevent the shipment of faulty products due to internal leakage.

However, in the case where the slit 35 is formed in the pipe mount plate 32 between the front and rear two pipe sockets 33, 34, a portion 36 of the plate under the slit 35 (indicated by chain lines in FIG. 5) is liable to become depleted of the brazing material. The depletion of the brazing material entails the likelihood of developing a shortcut channel. Furthermore, the brazed joint between the end plate 31 and the pipe mount plate 32 is prone to become incomplete at the edge portions defining the slit 35, similarly entailing the problem that a shortcut channel is very likely to develop.

We have conducted intensive research in view of the foregoing problems and found that the faulty brazed joint in the slit-defining edge portions of the pipe mount plate 32 is attributable to the presence of air remaining unremoved during brazing from the clearance of the slit 35 in the plate 32 as held between the outer surface of upper end of the end plate 31 and a jig on the same side, when a required number of intermediate plates (not shown), opposite end plates 31 and pipe mount plate 32 are assembled in layers, then held at the opposite sides of the assembly from outside using the jig like the one disclosed, for example, in JP-A No. 4-22571 and collectively brazed in a furnace as by the vacuum brazing method or flux brazing method for the fabrication of a heat exchange portion. More specifically, we have found that a complete brazed joint can not be formed owing to oxidation with the oxygen contained in the remaining air, consequently producing a faulty joint between the end plate 31 and the pipe mount plate 32 at the slit-defining edge portions.

We have found that when the components of the heat exchange portion are held assembled by a jig and heated in a furnace for collective brazing, such a situation is avoidable by allowing air to flow out during brazing from the clearance of the slit 35 in the pipe mount plate 32 as held between the outer surface of upper end of the end plate 31 and the jig disposed at the same side, whereby the present invention has been accomplished.

SUMMARY OF THE INVENTION

An object of the present invention is to provide a layered heat exchanger which is free of the foregoing problems.

The present invention provides a layered heat exchanger of the type which has a header portion at one side, i.e., a layered heat exchanger wherein an end plate at one of opposite sides of the exchanger is covered over an outer surface of an upper end portion thereof with a pipe mount plate having a fluid introduction pipe socket and a fluid discharge pipe socket arranged side by side respectively at front and rear, the pipe mount plate being brazed to the end plate. The heat exchanger is characterized in that the pipe mount plate has a cutout positioned between the fluid introduction pipe socket and the fluid discharge pipe socket, the cutout having a lower end left open downward at a lower end of the mount plate or an upper end left open upward at an upper end of the mount plate.

In fabricating this layered heat exchanger by assembling a required number of intermediate plates and opposite side end plates in superposed layers, with a pipe mount plate fitted over the outer surface of upper end portion of the end plate at one side, holding all of these components by a jig at opposite sides of the assembly from outside and heating the resulting assembly in this state in a furnace for collective brazing as by the vacuum brazing method or flux brazing method, air is allowed to flow out of the clearance of the cutout in the pipe mount plate as held between the upper-end outer surface of the end plate and the jig on the same side, via the open upper or lower end of the cutout. The air can therefore be removed effectively to ensure brazing, forming satisfactory fillets at the cutout edge portions to produce a reliable brazed joint between the end plate and the pipe mount plate, hence greatly improved brazability. Accordingly, the occurrence of a shortcut channel between the refrigerant introduction channel and the refrigerant discharge channel due to faulty brazing can be prevented more reliably.

The layered heat exchanger of the present invention is further characterized in that the cutout has an upper end extending upward to a level beyond an upper end of the fluid introduction pipe socket and an upper end of the fluid discharge pipe socket and has its lower end left open downward at the lower end of the mount plate, or has its upper end left open upward at the upper end of the mount plate and has a lower end extending downward to a level below a lower end of the fluid introduction pipe socket and a lower end of the fluid discharge pipe socket.

The heat exchanger is free of the likelihood that a shortcut channel will occur between the two pipe sockets.

Should a faulty brazed joint be formed between the end plate and the pipe mount plate to develop a shortcut channel, the presence of the cutout in the pipe mount plate reveals a liquid leak when the heat exchanger assembled is checked for fluid leakage, enabling the inspector to recognize the fault from outside easily for the reliable detection of the internal fluid leakage. The shipment of faulty products due to internal leakage is therefore avoidable.

The present invention will be described in greater detail with reference to the accompanying drawings.

DESCRIPTION OF THE PREFERRED EMBODIMENTS

Figure 1:
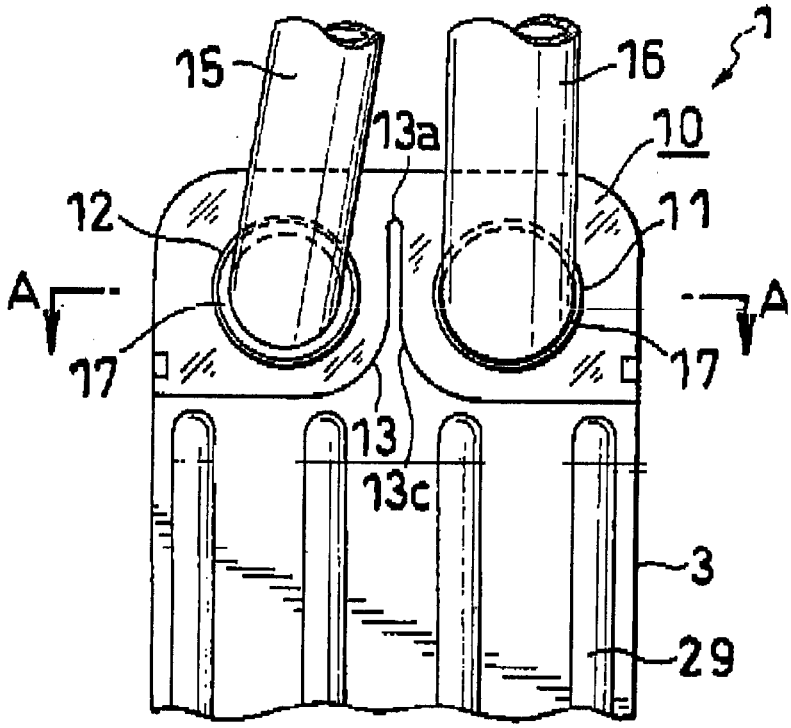
FIG. 1 is a fragmentary side elevation of the heat exchange portion of a layered evaporator as a first embodiment of the invention.

Throughout the drawings, like parts are designated by like reference numerals.

Figure 3:
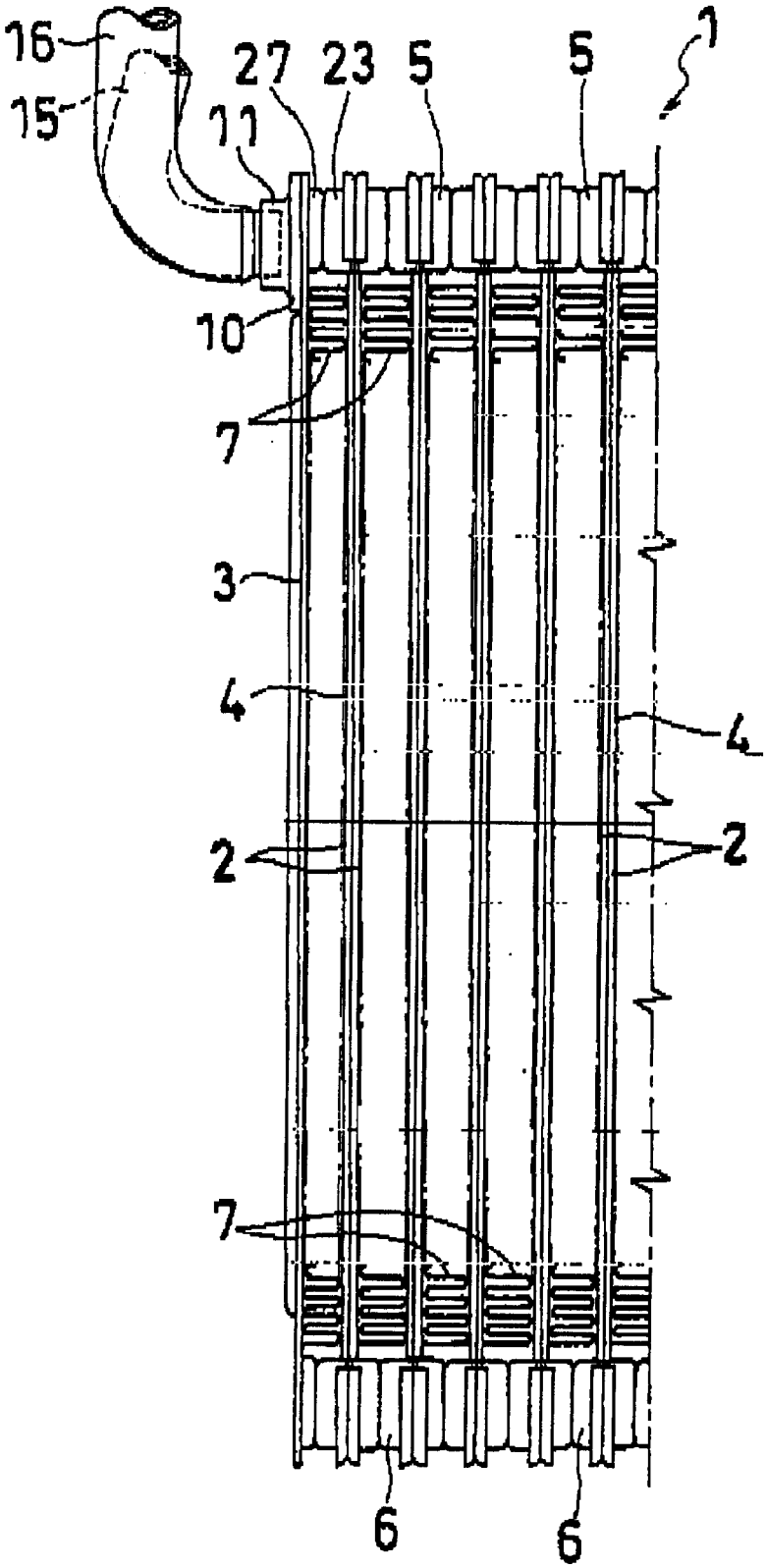
FIG. 3 is an enlarged fragmentary front view of the heat exchange portion of the layered evaporator of FIG. 1.

The terms "left," "right," "front," "rear," "upper" and "lower" as used herein are based on FIG. 3; the term "left" refers to the left-hand side of FIG. 3, the term "right" to the right-hand side of the same, the term "front" to the front side of the plane of the same drawing, the term "rear" to the rear side thereof, the term "upper" to the upper side of the same drawing, and the term "lower" to the lower side of the same.

The drawings show a layered evaporator embodying the invention for use in motor vehicle air conditioners.

Figure 2:
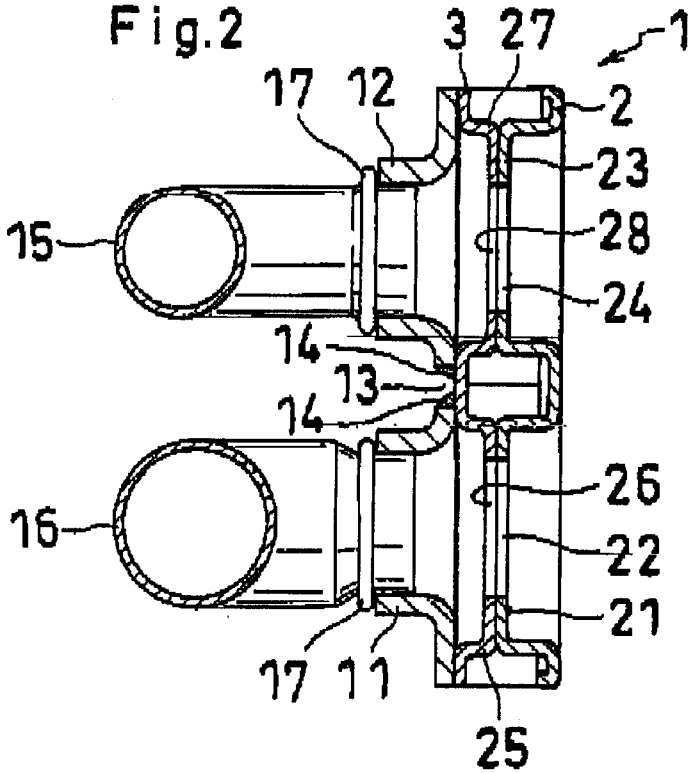
FIG. 2 is a view in section taken along the line A—A in FIG. 1.

FIGS. 1 to 3 show a layered heat exchanger of the invention, i.e., a first embodiment, for use as a layered evaporator 1.

With reference to these drawings, the evaporator 1 is made from aluminum (inclusive of aluminum alloys) and comprises a multiplicity of intermediate plates 2 arranged side by side in superposed layers, and end plates 3 positioned respectively at opposite ends, in the direction of superposition, of the assembly of the intermediate plates 2.

Each intermediate plate 2 is provided, on one side of each of the upper and lower ends thereof, with a pair of front and rear cuplike protrusions 21, 23 having respective tank-forming recesses inside thereof and respective refrigerant passage holes 22, 24 formed in their bottom portions. The intermediate portion of the height of the plate 2 provides a bulging portion having an inside recess for forming a refrigerant channel.

Further according to the present embodiment, the left plate 3 is provided, on the outer side of each of the upper and lower ends thereof, with a pair of front and rear cuplike protrusions 25, 27 having respective refrigerant channel forming recesses inside thereof and respective refrigerant passage holes 26, 28 formed in their bottom portions.

All the intermediate plates 2 are arranged in superposed layers, with the recesses of each pair of adjacent plates 2 opposed to each other, and the left and right end plates 3 are fitted over the respective opposite ends, in the direction of superposition, of the assembly of the plates 2 to form parallel flat tubular portions 4 and tank portions 5, 6 communicating respectively with the upper and lower ends of the flat tubular porions 4. Corrugated fins 7 are interposed between each pair of adjacent flat tubular portions 4, 4 and between each of the left and right end plates 3 and the flat tubular portion 4 immediately adjacent to the end plate.

The left end plate 3 is covered, over the outer surface of the upper end portion thereof, with a pipe mount plate 10 having a refrigerant discharge pipe socket 11 and a refrigerant introduction pipe socket 12 formed by burring and arranged side by side respectively at front and rear.

Especially according to the present invention, the pipe mount plate 10 has a cutout 13 positioned between the refrigerant discharge pipe socket 11 and the refrigerant introduction pipe socket 12. The cutout 13 has an upper end 13*a* extending to a level above the upper end of the refrigerant discharge pipe socket 11 and the upper end of the refrigerant introduction pipe socket 12, and has a lower end left open downward at the lower end of the plate 10 to provide an open end portion 13*c*.

With the present embodiment, the pipe socket 11 on the refrigerant discharge side of the pipe mount plate 10 is larger than the pipe socket 12 on the refrigerant introduction side of the plate 10 in diameter, so that the upper end 13*a* of the cutout 13 extends to a level above the upper end of the pipe socket 12. The left end plate 3 has parallel reinforcing ribs 29 under the portion thereof where the pipe mount plate 10 is attached.

Among the components of the layered evaporator 1 described, the intermediate plates 2 and the left and right end plates 3, 3 are made from an aluminum brazing sheet, while inner fins (not shown), the corrugated fins 7 and the pipe mount plate 10 are made from aluminum.

The heat exchange portion of the layered evaporator 1 described is fabricated by assembling a required number of intermediate plates 2 and opposite side end plates 3 in superposed layers, with a pipe mount plate 10 fitted over the outer surface of upper end portion of the left end plate 3, holding all of these components by a jig at opposite sides of the assembly from outside and collectively brazing the resulting assembly in this state in a furnace for as by the vacuum brazing method or flux brazing method.

When the components of the heat exchange portion of the layered evaporator 1 are heated in a furnace for collective brazing as by the vacuum brazing method or flux brazing method, air is allowed to flow out of the clearance of the cutout 13 in the pipe mount plate 10 as held between the upper-end outer surface of the end plate 3 and the jig on the same side, via the open lower end portion 13*c* of the cutout 13. The air can therefore be removed effectively to ensure furnace brazing as by the vacuum brazing method or flux brazing method, producing satisfactory fillets 14 even at the cutout edge portions to form a reliable brazed joint between the end plate 3 and the pipe mount plate 10, hence greatly improved brazability. Accordingly, the occurrence of a shortcut channel between the refrigerant introduction channel and the refrigerant discharge channel due to faulty brazing can be prevented more reliably.

Especially, the upper end 13*a* of the cutout 13 extends to a level above the upper end of the refrigerant discharge pipe socket 11 and the upper end of the refrigerant introduction pipe socket 12. This obviates the likelihood that a shortcut channel will occur between the two pipe sockets 11, 12.

Should a faulty brazed joint be formed between the end plate 3 and the pipe mount plate 10 to develop a shortcut channel, the presence of the cutout 13 in the pipe mount plate 10 reveals a liquid leak when the evaporator 1 assembled is checked for fluid leakage, enabling the inspector to recognize the fault from outside easily for the reliable detection of the internal fluid leakage. The shipment of faulty products due to internal leakage is therefore avoidable.

With the evaporator 1 described, a refrigerant discharge pipe 16 is inserted into the refrigerant discharge pipe socket 11 at the front on the mount plate 10 and joined thereto with a brazing material 17. A refrigerant introduction pipe 15 is inserted into the refrigerant introduction pipe socket 12 in the rear on the plate 10 and joined thereto with the brazing material 17.

With such an evaporator 1, a refrigerant is introduced into the left-end rear portion of upper tank 5 of the heat exchange portion from the introduction pipe 15, then passed through the refrigerant channels inside the heat exchange portion zigzag in its entirety and finally discharged from discharge pipe 16 at the left-end front portion of the upper tank 5.

On the other hand, air or air stream flows from the front of the evaporator heat exchange portion toward the rear side thereof to pass through the clearances provided with the corrugated fins 7 and formed between the adjacent flat tubular portions 4, 4 of the heat exchange portion and between each end plate 3 and the tubular porion 4 immediately adjacent thereto, and is subjected to efficient heat exchange with the refrigerant through the walls of the intermediate plates 2 and the corrugated fins 7.

Figure 4:
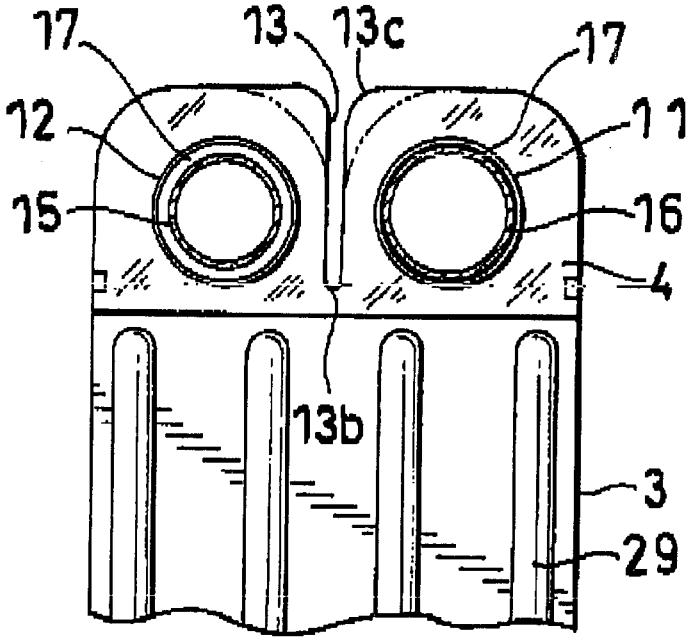
FIG. 4 is a fragmentary side elevation of the heat exchange portion of a layered evaporator as a second embodiment of the invention.
Figure 5:
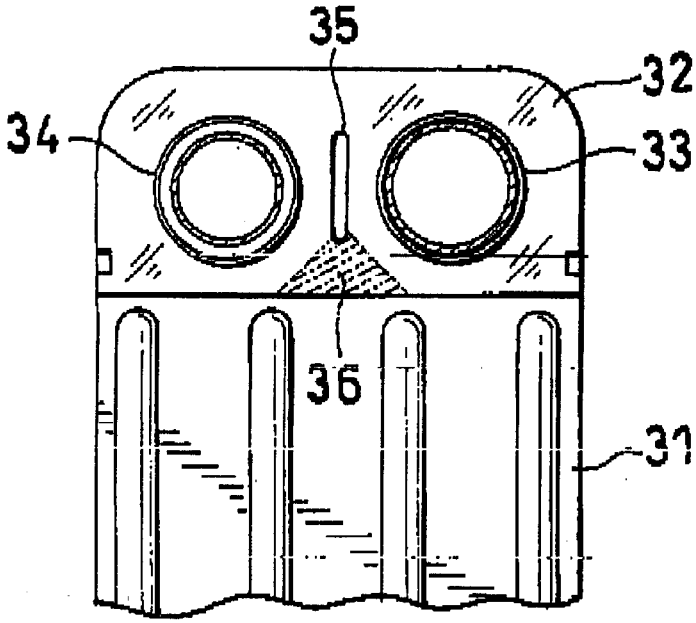
FIG. 5 is a fragmentary side elevation of a heat exchange portion for illustrating a faulty brazed joint in a conventional layered evaporator.

Next, FIG. 4 shows a second embodiment of the invention, which differs from the first embodiment in that the cutout 13 formed in the pipe mount plate 10 and positioned between the refrigerant introduction pipe socket 12 and the refrigerant discharge pipe socket 11 on the plate 10 has an upper end left open upward at the upper end of the mount plate 10 to provide an open end portion 13*c*, and a lower end 13*b* extending to a level below a lower end of the refrigerant introduction pipe socket 12 and a lower end of the refrigerant discharge pipe socket 11.

When the components of the heat exchange portion of the layered evaporator 1 according to the second embodiment are heated in a furnace for collective brazing as by the vacuum brazing method or flux brazing method to fabricate the heat exchange portion, air is allowed to flow out of the clearance of the cutout 13 in the pipe mount plate 10 as held between the upper-end outer surface of the end plate 3 and a jig on the same side, via the open upper end portion 13*c* of the cutout 13.

Especially, the lower end 13*b* of the cutout 13 extends to a level below the lower end of the refrigerant discharge pipe socket 11 and the lower end of the refrigerant introduction pipe socket 12. This obviates the likelihood that a shortcut channel will occur between the two pipe sockets 11, 12.

The open upper end portion 13*c* of the cutout 13 in the illustrated pipe mount plate 10 has a relatively small width, whereas the open upper end portion 13*c* of the cutout 13 may have an increased width as indicated in two-dot chain lines in FIG. 4 as is the case with the first embodiment.

With the exception of the above feature, the second embodiment has the same construction as the first, so that like parts are designated by like reference numerals throughout the drawings concerned.

Although the pipe mount plate 10 having the cutout 13 and covering the upper-end outer surface of the left end plate 3 of the layered evaporator 1 is brazed to the end plate 3 according to the embodiments described, the pipe mount plate 10 may alternatively cover the upper-end outer surface of the right end plate 3 and brazed to this end plate.

While the tank portions 5, 6 are provided respectively at the upper and lower sides of the assembly of superposed intermediate plates 2 in the case of the illustrated heat exchanger, the present invention is similarly applicable to layered heat exchangers wherein tank portions are provided only at one of the upper and lower sides of the layered assembly of intermediate plates 2.

The layered heat exchanger of the present invention is not only useful as a layered evaporator for use in motor vehicle air conditioners like the foregoing embodiments but also similarly usable in oil coolers, aftercoolers, radiators, etc.

What is claimed is:

1. A layered heat exchanger comprising:

an end plate at one of opposite sides of the exchanger, a pipe mount plate covering over an outer surface of an upper end portion of the end plate, the pipe mount plate including a fluid introduction pipe socket and a fluid discharge pipe socket arranged side by side respectively at front and rear, the pipe mount plate being brazed to the end plate, the pipe mount plate comprising a cutout positioned between the fluid introduction pipe socket and the fluid discharge pipe socket, the cutout having a lower end left open downward at a lower end of the mount plate or an upper end left open upward at an upper end of the mount plate, and wherein the cutout has an upper end extending to a level above an upper end of the fluid introduction pipe socket and an upper end of the fluid discharge pipe socket and has its lower end left open downward at the lower end of the mount plate, or has its upper end left open upward at the upper end of the mount plate and has a lower end extending to a level below a lower end of the fluid introduction pipe socket and a lower end of the fluid discharge pipe socket.

2. A layered heat exchanger comprising:

an end plate at one of opposite sides of the exchanger, a pipe mount plate covering over an outer surface of an upper end portion of the end plate, the pipe mount plate including a fluid introduction pipe socket and a fluid discharge pipe socket arranged side by side respectively at front and rear, the pipe mount plate being brazed to the end plate, the pipe mount plate comprising a cutout positioned between the fluid introduction pipe socket and the fluid discharge pipe socket, the cutout having a lower end left open downward at a lower end of the mount plate or an upper end left open upward at an upper end of the mount plate, and cutout edge portions of the pipe mount plate are brazed to the end plate.

3. The layered heat exchanger according to claim 2, wherein the cutout is located on the pipe mount plate at a flat portion between the fluid introduction pipe socket and the fluid discharge pipe socket.

4. The layered heat exchanger according to claim 2, wherein fillets are formed at the cutout edge portions of the pipe mount plate by brazing the pipe mount plate to the end plate.

5. The layered heat exchanger according to claim 4, wherein the cutout is located on the pipe mount plate at a flat portion between the fluid introduction pipe socket and the fluid discharge pipe socket.

6. The layered heat exchanger according to claim 2, wherein the pipe mount plate is substantially planar and the fluid introduction pipe socket and the fluid discharge pipe socket are formed in the pipe mount plate by burring.

7. The layered heat exchanger according to claim 6, wherein the cutout is located on the pipe mount plate at a flat portion between the fluid introduction pipe socket and the fluid discharge pipe socket.

8. A layered heat exchanger comprising:

an end plate at one of opposite sides of the exchanger, a pipe mount plate covering over an outer surface of an upper end portion of the end plate, the pipe mount plate including a fluid introduction pipe socket and a fluid discharge pipe socket arranged side by side respectively at front and rear, the pipe mount plate being brazed to the end plate, the pipe mount plate comprising a cutout positioned between the fluid introduction pipe socket and the fluid discharge pipe socket, the cutout having a lower end left open downward at a lower end of the mount plate or an upper end left open upward at an upper end of the mount plate, and wherein the pipe mount plate is substantially planar.

* * * * *